US007427244B1

(12) United States Patent
Patel

(10) Patent No.: US 7,427,244 B1
(45) Date of Patent: Sep. 23, 2008

(54) BASKETBALL TRAINING DEVICE

(76) Inventor: Dipak M. Patel, 12177 Highway 90, Luling, LA (US) 70070

( * ) Notice: Subject to any disclaimer, the term of this patent is extended or adjusted under 35 U.S.C. 154(b) by 266 days.

(21) Appl. No.: 11/370,150

(22) Filed: Mar. 6, 2006

Related U.S. Application Data

(60) Provisional application No. 60/669,630, filed on Apr. 8, 2005.

(51) Int. Cl.
*A63B 69/00* (2006.01)

(52) U.S. Cl. ..... 473/448; D21/783; 473/447

(58) Field of Classification Search ..... 473/448, 473/479, 449, 422; D21/704, 780, 781; 70/57
See application file for complete search history.

(56) References Cited

U.S. PATENT DOCUMENTS

| | | | | | |
|---|---|---|---|---|---|
| 1,904,836 | A | | 4/1933 | Peoples | |
| 2,918,283 | A | | 12/1959 | Marschalk | |
| 3,160,414 | A | * | 12/1964 | Gray | 473/448 |
| 3,173,687 | A | * | 3/1965 | Hair | 473/449 |
| 3,471,150 | A | * | 10/1969 | Kaerwer | 473/449 |
| D233,162 | S | * | 10/1974 | Hayden | D21/780 |
| 4,206,915 | A | | 6/1980 | Woodcock | |
| 5,102,537 | A | | 4/1992 | Jones | |
| 5,354,048 | A | * | 10/1994 | Winesberry, Jr. | 473/447 |
| 5,364,092 | A | | 11/1994 | Riepe et al. | |
| D368,942 | S | | 4/1996 | Mahoney | |
| 5,800,290 | A | | 9/1998 | Barry | |
| 5,830,088 | A | * | 11/1998 | Franklin de Abreu | 473/433 |
| 5,881,583 | A | * | 3/1999 | Booker et al. | 70/57 |
| 6,190,270 | B1 | * | 2/2001 | Barry | 473/438 |
| 6,458,050 | B2 | * | 10/2002 | Barry | 473/438 |
| 6,652,396 | B2 | | 11/2003 | McBride | |
| 2001/0005701 | A1 | * | 6/2001 | Barry | 473/438 |

* cited by examiner

*Primary Examiner*—Gene Kim
*Assistant Examiner*—M Chambers
(74) *Attorney, Agent, or Firm*—Garvey, Smith, Nehrbass & North, L.L.C.; Brett A. North

(57) ABSTRACT

A basketball training device adapted to be detachably mounted directly on a basketball goal to provide a target at which the player aims and strikes with the basketball in order to improve the form and accuracy of the player's shooting. The device comprises a base with a plurality of projections attached to the base. The plurality of projections are adapted and configured to bend and allow the ball freely move through the goal without substantially affecting the trajectory of the ball and to substantially resume their original position after the ball has passed through the goal.

20 Claims, 4 Drawing Sheets

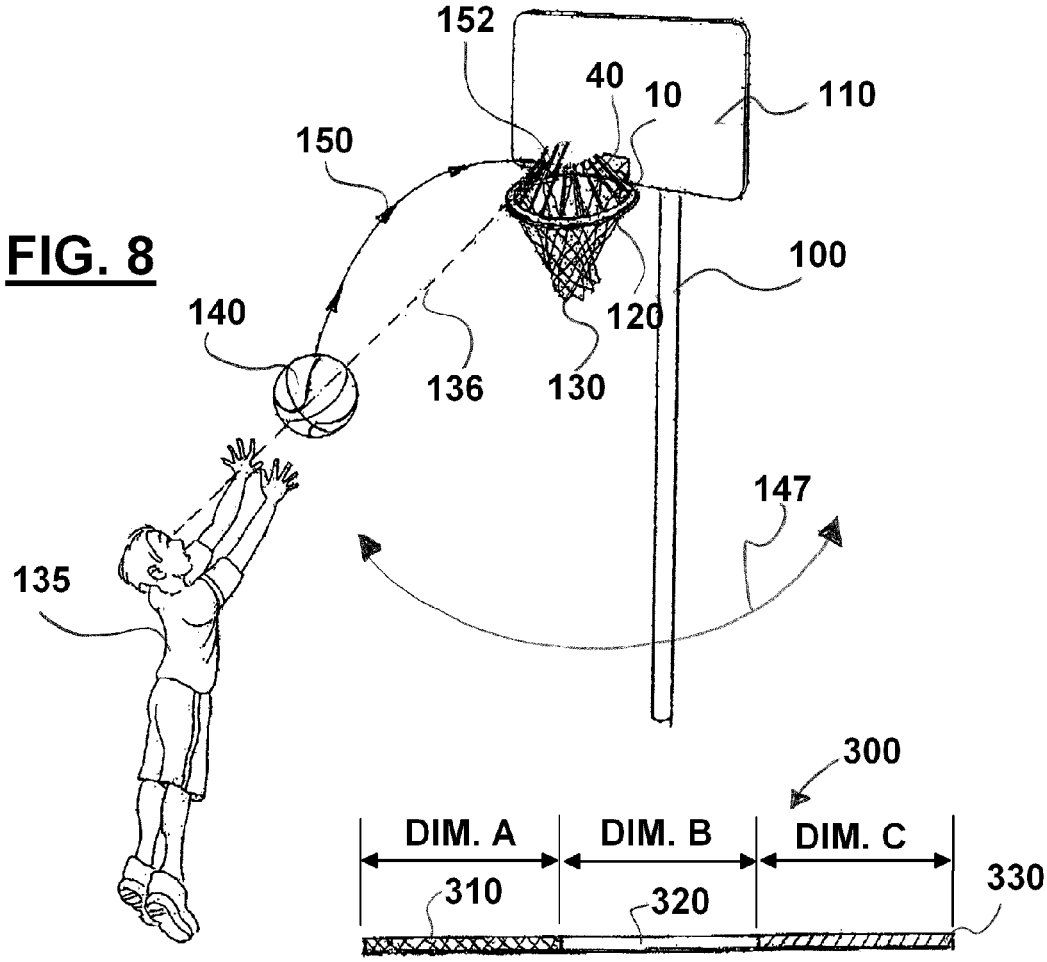
FIG. 8
FIG. 9
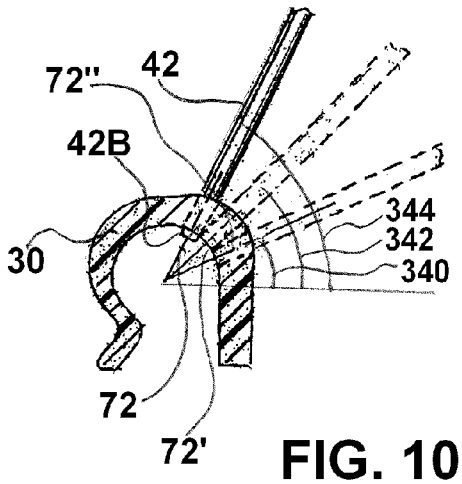
FIG. 10
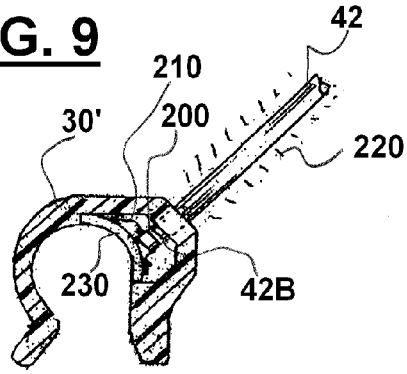
FIG. 11

BASKETBALL TRAINING DEVICE

CROSS-REFERENCE TO RELATED APPLICATIONS

Priority of U.S. Provisional Patent Application Ser. No. 60/669,630, filed Apr. 8, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to training devices for the sport of basketball. More particularly, the present invention relates to a method and apparatus for training a basketball player to improve the accuracy of his shots using a training device attached to the basketball goal.

Various training devices have been designed in an attempt to improve the shooting accuracy basketball players. At least two types of shooting aids have been proposed. The first type of shooting aid causes the basketball to miss or deflect away from the goal thus allowing only highly accurate and desirable shots to score. The second type of shooting aid provides a visual target for the player to aim and shoot at when shooting at the goal.

One example of a basketball practice device which operates by deflecting shots with undesirable trajectories is U.S. Pat. No. 4,206,915 to Woodcock. This patent has as its principal object a device which will deflect shots having a flat trajectory and encourage shooters to place a higher arc or trajectory on a shot. The device has a C-ring adapted to attach to the basketball hoop with a plurality of radially, laterally extending legs which extend outwardly from the rim about four to six inches. A free-standing member is mounted on each leg which projects at least about two to four inches over the rim. The free-standing member is positioned to deflect basketball shots having undesirable trajectories. The object and purpose of the free-standing members are for the shooter to aim and shoot over the free-standing members so that the shooter develops a high arcing shot. The disadvantage of this device is that it does not provide a visual target or focus point for the player to aim at when shooting the basketball. In addition, this device does not provide positive reenforcement when the player makes a proper shot, but rather it only indicates when the player has made an improper shot having a low, flat trajectory.

An example of the second type of shooting aid providing a target is U.S. Pat. No. 4,244,569 to Wong which discloses a target in the form of a brightly colored ball which extends from the backboard at a position below the basketball rim or hoop to a position substantially immediately below and at the center of the basketball hoop. This apparatus has disadvantages in that the target is not easily visible in its position immediately below the rim and in the center of the hoop.

A different example of the second type of practice shooting aid is U.S. Pat. No. 4,506,886 to Lamb, Sr. which discloses a basketball practice apparatus which extends from the backboard at a position above the rim and positions a target ball above the rim and at the center of the hoop area. This basketball shooting apparatus has disadvantages because the holding apparatus for the target restricts use of the backboard and prevents use of the apparatus in scrimmages or games.

Another example of the second type of practice shooting aid is U.S. Pat. No. 5,800,290 to Barry which discloses a shooting aid which can be mounted on the rim of a basketball goal. This basketball shooting apparatus has disadvantages because it fails to provide a uniform target to a player shooting at different positions relative to the basketball goal.

There is a need for a basketball training device for improving shooting accuracy which uses a target positioned above the front of the basketball rim and presenting an unobscured aiming or focus point for the shooter regardless of the relative angular position of the shooter to the goal. It is an object of the basketball shooting device to teach the shooter to place his shots to increase accuracy.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a basketball training device which can be mounted on a rim, and used to improve the shooting accuracy of a player. In one embodiment the training device comprises a base detachably mountable on the rim of a basketball goal, and includes a plurality of spaced apart projections extending upwardly and radially inward. The projections act as targets for the shooter when shooting the basketball. In one embodiment impacted projections, when contacted by a basketball, will deflect away without substantially affecting or altering the trajectory of the basketball. The basketball deflecting one or more of projections when passing through the rim, provides the player with positive feedback and a sense of an accurate, proper shot.

One embodiment provides a training device attachable to a basketball rim aiding in teaching proper aiming and shooting techniques. In one embodiment a visual target is provided displaying an aiming or focus point regardless of the relative position of the player to the basketball goal. In one embodiment positive feedback is provided regarding whether a proper shot was made. In one embodiment, after consistent usage of a basketball training device, an image or illusion of a target will appear to the player without the training device actually being in place.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 8 is a perspective view of a player taking a shot at the goal of FIG. 6;

FIG. 9 is an alternative embodiment of a projection;

FIG. 10 is a sectional view of an alternative embodiment of a base having multiple positions for projections; and FIG. 11 a sectional view of an alternative embodiment where the projections can be lighted;

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 6:
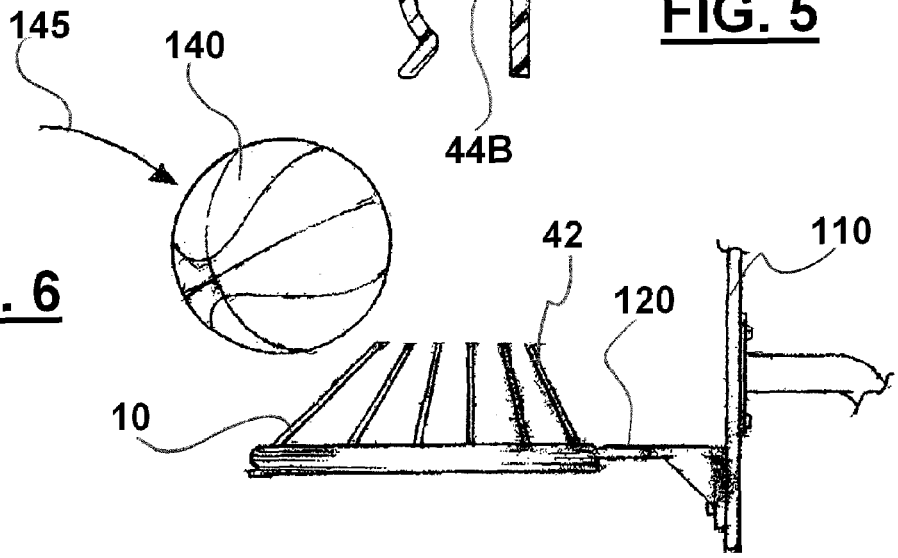
FIG. 6 is side view of a basketball approaching a goal having a training device.
Figure 7:
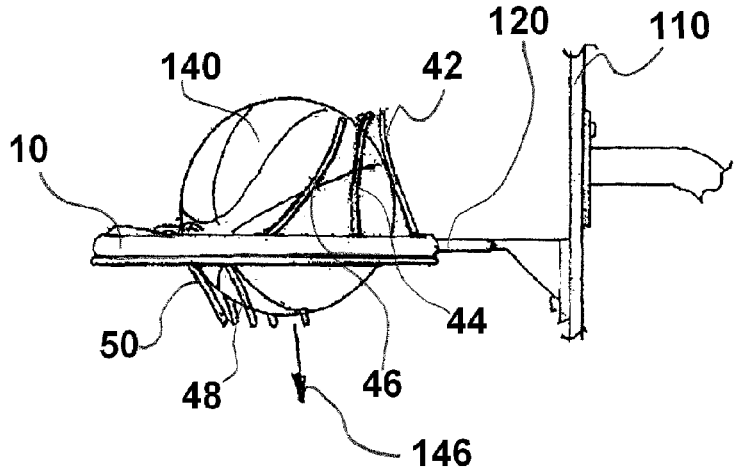
FIG. 7 is a side view of the basketball of FIG. 6 passing through the goal.

As shown in FIG. 8, basketball goal 100 can be mounted on backboard 110 using a conventional bracketing arrangement (not shown). Shown mounted on rim 30 of basketball goal 100 is one embodiment of basketball training device 10. Player 135 is shown shooting basketball 140. Player 135 is shown aiming at position 152 (of training device 10) through player's line of sight 136. In this shot basketball 140 has trajectory 150 and enters rim 120 of basketball goal 100. After this shot is made, FIG. 6 shows basketball 140 about to enter rim 120, and FIG. 7 shows it passing through rim 120.

Figure 2:
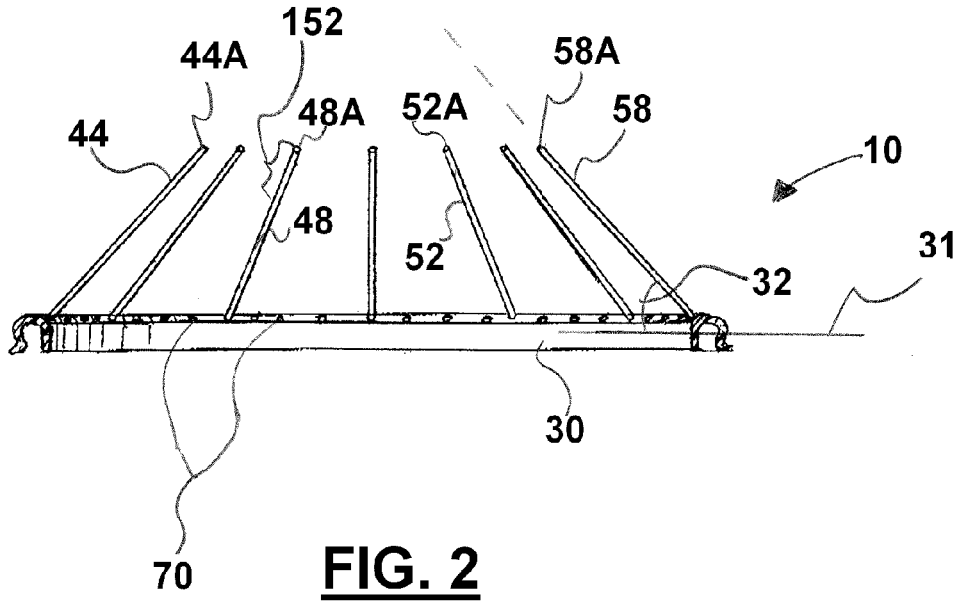
FIG. 2 is sectional view of the training device of FIG. 1 taken along the lines 2-2.
Figure 3:
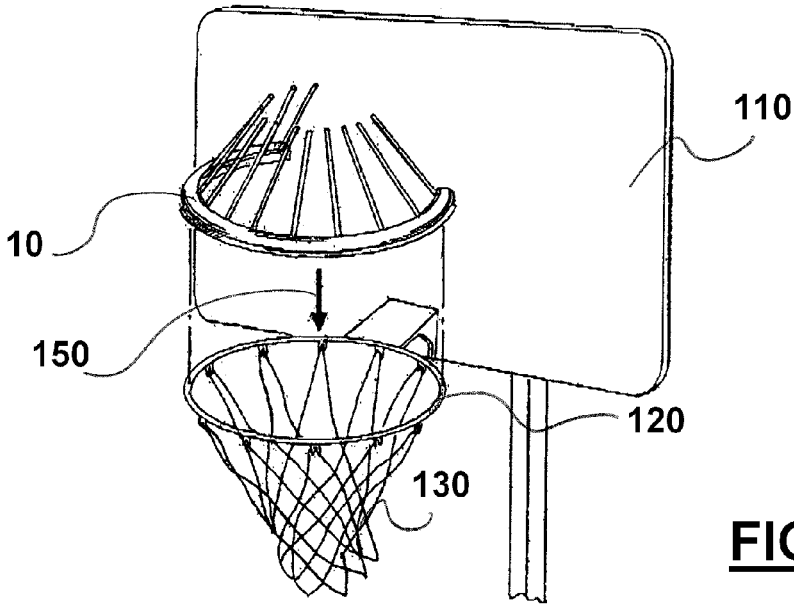
FIG. 3 is a perspective view of the training device of FIG. 1 being placed on a basketball goal.
Figure 4:
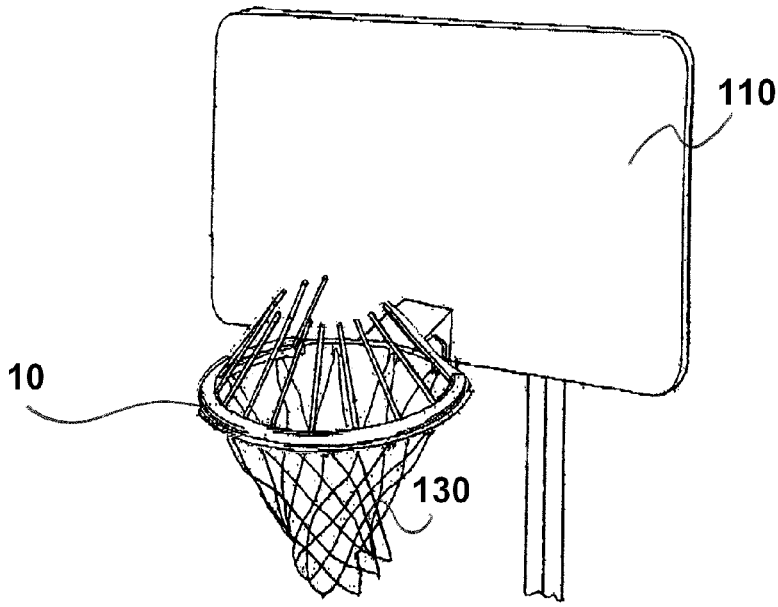
FIG. 4 is perspective view of the training device of FIG. 1 installed on a basketball goal.

One benefit of training device 10 is that player 135 sees relatively the same shooting position 152,152A, 152B, etc., regardless of his angular position on arrow 147 relative to basketball goal 100. Shooting position 152,152A,152B, etc. can be a point on one or more projections or can be an area on one or more projections. Depending on his relative angular position to basketball goal 100, player 135 will see one or more shooting positions 152,152A,152B, etc. FIG. 2 shows shooting position 152 being an area on projection 48 extending downward from tip 48A. When shooting basketball 140, player 135 aims for and shoots at shooting positions 152, 152A, etc. Positions 152, 152A, etc. being above rim 120 give player 135 a shooting target and cause the player to aim over rim 120, and not at it. Player 135 using training device 10 over time will develop a sense of where and how to shoot basketball 140 and greatly improve his shooting skills. It is expected that over time player 135 will be able to mentally visualize points 152,152A, etc. where training device 10 is not attached to rim 120.

Figure 1:
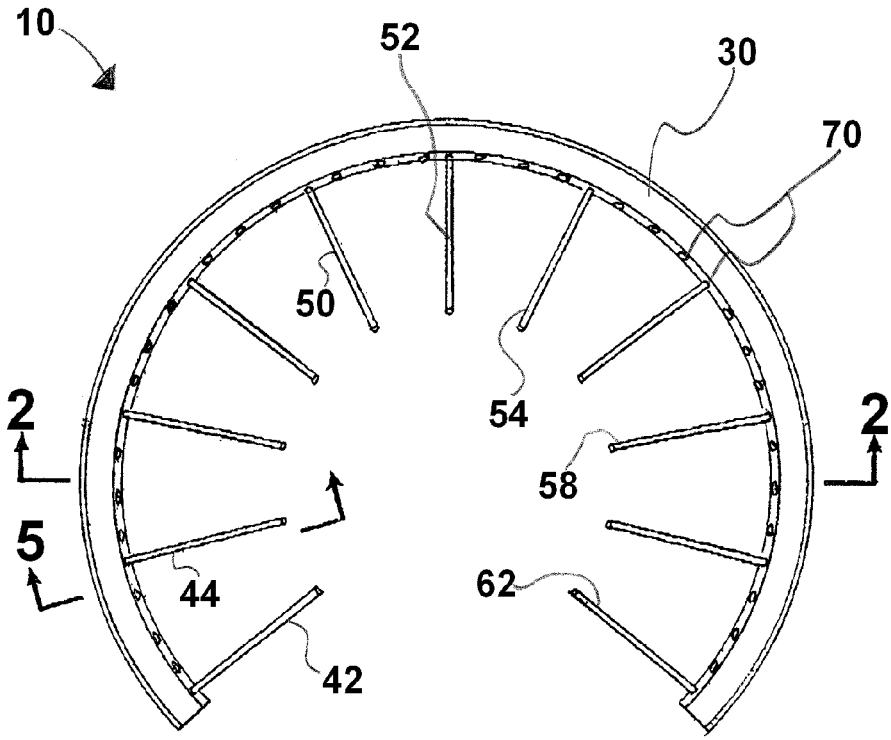
FIG. 1 is a top view of a preferred basketball training device.

As shown in FIGS. 1 and 2, basketball training device 10 can comprise base 30 and plurality of prongs 40. In one embodiment projections 42,44,46,48,50,52,54,56,58,60, and 62 are included. Plurality of projections 40 can be attached to base 30 through a plurality of plurality of spaced apart openings 70 located around base 30. Base 30 preferably includes a c-section (see FIG. 10) cross section allowing base 30 to removably snap on rim 120. It is preferred that base 30 be adapted and configured to be removably attached to most basketball rims including both older styles and new styles (having an extra piece of rounded edging on the underside of the rim). Preferably, base 30 is a material having the requisite strength and durability withstanding impact loads such as by being hit by basketball 140, and will not be damages by such impact loads. A suitable material is injection molded plastic, rubber, metals such as aluminum, steel, etc. machined or molded to fit a rim 120, other configurations allowing attachment to goals 100.

In one embodiment, base 30 includes a plurality of projections 40 extending upwardly and radially inward from base 30. The tips 40A of plurality of projections 40 can form targets for player 135. Plurality of projections 40 can be made of any material which has the requisite strength and durability characteristics such that they will flex and not be damaged when struck by basketball 140. For example, plurality of projections can be formed from polymers, nylons (e.g., nylon 6 or nylon 16), plastics, urethanes, rubber, coiled metal springs, fiber optical material, or a combination of these materials. Plurality of projections 40 can be of any resilient flexible material such that they will withstand impact loads of basketballs by deflecting or flexing when basketball 140 strikes or impacts. Preferably, the impacted plurality of projections 40 will bend or deflect out of the path basketball 140 without substantially altering ball's trajectory 150 (see FIGS. 6 through 8). Also preferably, the impacted plurality of projections 40 return to their original position after basketball 140 passes through rim 120. Accordingly, after the shot player 135 will see the same target position 152,152A,152B, etc. for the next shot.

The tips 40A of plurality of projections 40 may be any suitable shape, but preferably are distinctly colored to be visible. Alternatively, the lengths of plurality of projections can be multi-colored (see FIG. 9) setting up zones of areas for proper shots.

Figure 5:
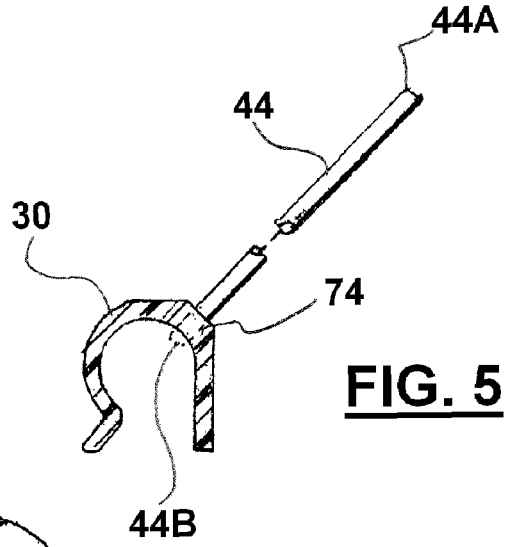
FIG. 5 is sectional view of the training device of FIG. 1 taken along the lines 5-5.

Plurality of projections 40 can be attached to base 30 by any suitable means such a plurality of openings 70 in which projections 40 frictionally fit. For example, the ends of projections (e.g. 44B) can be enlarged with respect to the openings (e.g., 74) through which through which the projections are placed (see FIG. 5). Alternatively, projections 40 and base 30 can be molded as a single piece, however, this suffers from the inability to replace individual damages projections (e.g., projection 42). Alternatively projections 40 can be connected using adhesives or bonding (glue, welding, etc.) or fasteners (e.g., screws, rivets, pin fasteners or any like fastening devices).

As shown in FIG. 2, preferably, projections 40 will be between 2 and 9 inches; more preferably between 4 and 7 inches, more preferably between 5 and 7 inches, and most preferably 7 inches. Preferably projections 40 will have an angle 32 from the horizontal 31 of between 15 and 75 degrees, more preferably between 20 and 70 degrees, more preferably between 25 and 65 degrees, more preferably between 30 and 60 degrees, more preferably between 35 and 55 degrees, more preferably between 40 and 50 degrees, and most preferably 45 degrees.

FIG. 9 shows another embodiment wherein one or more of the plurality of projections 40 are multi-colored. Here, projection 300 is shown having colored portions 310,320,330. These colored portions can be set to create colored zones for player 135. For example, a brightly colored zone can be included closest to tips farthest away from base 30. In another embodiment the main focus of the color can be at the area of each projection 40 closes to base 30. In this embodiment the colors would become less bright as one gets farther away from base 30. Having the main focus closest to base 30 allows player 135 to see above base 30 (and rim 120) and shoot or aim for this target. As an example area 310 can be red, area 320 yellow, and area 330 orange—where area 310 is located closest to base 30.

FIG. 10 shows another embodiment wherein base 30 includes base 30 includes a plurality of openings 72, 72', 72" wherein a projection 42 can be placed at respective angles 344,342,340. In this embodiment player 135 has the option of changing the angle of plurality of projections 40 to assist in him making the best shot. For example, if player 135 is shooting low, then he can increase the relative angle of plurality of projections (e.g., from angle 340 to angle 342). In another embodiment, player 135 can increase the longitudinal length of plurality of projections 40.

FIG. 11 shows another embodiment where one or more of the plurality of projections 40 can be lighted. In this embodiment base 30 can comprise a plurality of light sources 200 located adjacent plurality of projections 40 to be lighted. Projection 42 shows emitted light 220. Light sources 200 can be conventionally available L.E.D. lights or other light sources which are small enough to fit inside base 30. Light source 200 is shown having power source 210, which can be an electrical wire connected to an electrical power source 210, such as a battery or other power source. Preferably, the plurality of light sources 200 are connected in parallel so that if one light burns out the remainder of lights will still work. Also preferably, backing 230 is used to protect plurality of light sources 200 from damage by rim 120. Furthermore, flashing lights can be used. This embodiment can be combined with the embodiment of FIG. 9 where a zone of optically lit portion is included in plurality of projections 40. For example, third portion 330 of one or more projections 300 can be set to allow light to be emitted while the remainder of projections 300 do not emit light. Accordingly, a lighted zone above rim 120 would be seen by player 135. Lighted projections also allow player 135 to play at night without external illumination.

The following is a list of reference numerals:

LIST FOR REFERENCE NUMERALS

| (Reference No.) | (Description) |
|---|---|
| 10 | training device |
| 30 | base |
| 40 | plurality of projections |
| 41 | angle |
| 42 | projection |
| 44 | projection |
| 46 | projection |
| 48 | projection |
| 50 | projection |
| 52 | projection |
| 54 | projection |
| 56 | projection |
| 58 | projection |
| 60 | projection |
| 62 | projection |
| 70 | plurality of openings |
| 72 | opening |
| 74 | opening |
| 76 | opening |
| 78 | opening |
| 80 | opening |
| 82 | opening |
| 84 | opening |

-continued

LIST FOR REFERENCE NUMERALS

| (Reference No.) | (Description) |
|---|---|
| 86 | opening |
| 88 | opening |
| 90 | opening |
| 92 | opening |
| 100 | basketball goal |
| 110 | backboard |
| 120 | rim |
| 130 | net |
| 135 | player |
| 136 | line of sight |
| 140 | basketball |
| 145 | arrow |
| 146 | arrow |
| 147 | arrow |
| 150 | trajectory |
| 152 | point |
| 200 | light source |
| 210 | power source |
| 220 | emitted light |
| 230 | backing |
| 300 | projection |
| 310 | first portion |
| 320 | second portion |
| 330 | third portion |
| 340 | angle |
| 342 | angle |
| 344 | angle |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

I claim:

1. A basketball training device attachable to a basketball rim for improving the accuracy and shooting form of a player by providing a visual target to aim at comprising:

(a) a base adaptable to be attached to the basketball rim, the base being removably attachable to the basketball rim, the base forming at least part of a circle, the circle being located on a plane, the plane having both upper and lower sides; and (b) a plurality of projections extending from the base, each projection including a substantially straight elongated member having first and second ends, each elongated member being connected adjacent its first end to the clamp and extending radially inwardly and upwardly from the clamp such that its second end is located at a point distal from the clamp above the upper side of the place and towards the center of the circle wherein at least a portion of each elongated member is resiliently flexible such that it will bend when is struck allowing the basketball to pass through the basketball rim without substantially altering a trajectory of the basketball and return to its original configuration after the basketball has passed through the rim.

2. The training device of claim 1, wherein the base comprises a substantially C-shaped base portion having an opening adapted to fit over the basketball rim.

3. The training device of claim 1, wherein each projection of the plurality of projections are integral with the base.

4. The training device of claim 1, wherein the projections are threaded into the base.

5. The training device of claim 1, wherein each projection is at least partially formed of a polymer.

6. The training device of claim 1, wherein each projection is at least partially is formed of rubber.

7. The training device of claim 1, wherein each projection is at least partially is formed by a coil spring.

8. The training device of claim 1, wherein each projection is made of a soft, deformably elastic material.

9. The training device of claim 1, wherein each projection is colored differently than the base.

10. The training device of claim 1, wherein each projection includes a plurality of colors.

11. The training device of claim 9, wherein each projection includes three zones of colors along each elongated member.

12. The training device of claim 1, wherein the base includes multiple positions for angularly adjusting the plurality of projections.

13. The training device of claim 1, wherein the base includes multiple positions for adjusting the plurality of projections around the circle.

14. The training device of claim 1, wherein the plurality of projections are lighted.

15. The training device of claim 1, wherein the plurality of projections forms an angle with the plane of forty five degrees.

16. The training device of claim 1, wherein there are at least 10 projections.

17. The training device of claim 1, wherein there are 11 projections.

18. The training device of claim 1, wherein a ball passing through the rim will bend downward some projections and bend upward some projections.

19. The training device of claim 1, wherein the projections are replaceable if broken.

20. A method of teaching a basketball player improved form and accuracy in shooting basketballs comprising the steps of:

(a) providing at least one basketball training device comprising a base adaptable to be attached to a basketball rim, the base being removably attachable to the basketball rim, the base forming at least part of a circle, the circle being located on a plane, the plane having both upper and lower sides; and a plurality of projections extending from the base, each projection including a substantially straight elongated member having first and second ends and having a resiliently flexible portion each elongated member being connected adjacent its first end to the clamp and extending radially inwardly and upwardly from the clamp such that its second end is located at a point distal from the clamp above the upper side of the place and towards the center of the circle;

(b) mounting the basketball training device to the rim; and (c) instructing the player to aim and strike part of at least one of the elongated members so that the player masters shooting over the front of the rim.

* * * * *